US006838969B2

(12) United States Patent
Suda

(10) Patent No.: US 6,838,969 B2
(45) Date of Patent: Jan. 4, 2005

(54) ELECTROMAGNET ASSEMBLY FOR ELECTROMAGNETIC APPARATUS

(75) Inventor: Yoshiyuki Suda, Isesaki (JP)

(73) Assignee: Sanden Corporation, Gunma (JP)

( * ) Notice: Subject to any disclaimer, the term of this patent is extended or adjusted under 35 U.S.C. 154(b) by 20 days.

(21) Appl. No.: 10/331,347

(22) Filed: Dec. 31, 2002

(65) Prior Publication Data

US 2003/0102950 A1 Jun. 5, 2003

Related U.S. Application Data

(62) Division of application No. 09/788,442, filed on Feb. 21, 2001, now Pat. No. 6,512,440.

(30) Foreign Application Priority Data

Feb. 29, 2000 (JP) ..... P2000-057932

(51) Int. Cl.[7] ..... H01F 27/02
(52) U.S. Cl. ..... 336/90; 335/296; 192/84.961
(58) Field of Search ..... 336/90, 107, 192, 336/198; 335/285, 296; 192/84.96, 84.1, 81.9, 84.961

(56) References Cited

U.S. PATENT DOCUMENTS 4,432,446 A * 2/1984 Okano et al. ..... 192/84.961
4,935,713 A * 6/1990 Bekheet ..... 335/296
5,307,038 A * 4/1994 Ishimaru ..... 335/296
5,967,282 A * 10/1999 Takahashi ..... 192/84.961
6,091,590 A * 7/2000 Sakamoto ..... 361/41
6,371,270 B1 * 4/2002 Matsumoto ..... 192/84.961
6,512,440 B2 * 1/2003 Suda ..... 336/192
6,587,024 B2 * 7/2003 Matsumoto ..... 336/198

FOREIGN PATENT DOCUMENTS

| | | |
|---|---|---|
| DE | 3024894 | 1/1982 |
| DE | 19640261 | 4/1998 |
| EP | 0806583 | 11/1997 |
| JP | 7296896 | 11/1995 |

* cited by examiner

*Primary Examiner*—Tuyen T. Nguyen
(74) *Attorney, Agent, or Firm*—Baker Botts L.L.P.

(57) ABSTRACT

An electromagnet assembly for an electromagnetic apparatus has a ring member, a coil bobbin having an electrical wire wound a spool of the ring member, and a ring case. The ring member is disposed in an annular groove of the ring case. An opening is formed through the ring case adjacent to its closed end surface. A connector, which is disposed on the ring case and covers the opening, includes a case having a closed shape and a bottom, and a cap closing an open end of the case. Ends of the electrical wire and ends of a lead wire are joined in the connector. A projection portion is formed around a fringe portion of a first end surface of the cap and abuts an open end surface of the case. The cap is secured fixedly to the case after the projection portion is melted.

3 Claims, 17 Drawing Sheets

ELECTROMAGNET ASSEMBLY FOR ELECTROMAGNETIC APPARATUS

The present application is a divisional application of U.S. patent application Ser. No. 09/788,442 filed on Feb. 21, 2001, now U.S. Pat. No. 6,512,440 entitled "Electromagnet Assembly for Electromagnetic Apparatus," the disclosure of which is incorporated herein by reference in its intirety.

BACKGROUND OF THE INVENTION

1. Field of the Invention

The present invention relates to an electromagnet assembly for use in an electromagnetic apparatus, such as an electromagnetic clutch for use in controlling the transmission of power from an automobile engine to a refrigerant compressor in an automobile air conditioning system. More particularly, it relates to a connector in the electromagnet assembly.

2. Description of Related Art

Referring to FIG. 1, an electromagnet assembly 7, which comprises a ring member 1, a coil bobbin 3, and a ring case 4, is known in the art. Ring member 1 has a toroidal shape having a spool portion, which has an exterior open edge formed by two annular flanges on the spool portion. Coil bobbin 3 has ring member 1 and an electrical wire 2, which is wound around the spool portion of ring member 1. Ring case 4 has an annular groove, an open edge of which is in a direction parallel to its axis. Coil bobbin 3 is inserted into the annular groove of ring case 4. An opening 4*a* is formed through ring case 4 adjacent to its closed end surface. A connector 5 is disposed on ring case 4 adjacent to its closed end surface and covers opening 4*a*. A first end 2*a* and a second end 2*b* of electrical wire 2 and a first lead 6*a* and a second lead 6*b* are joined, respectively in connector 5. Electromagnet assembly 7, for example, is used in an electromagnetic clutch 9 of a compressor 8 in an automobile air conditioning system, as shown in FIG. 2. Electromagnet assembly 7 engages compressor 8 through a ring-shaped plate 10, which is affixed to the closed end surface of ring case 4.

Referring to FIGS. 3–6, the connecting structure between connector 5 and ring case 4 and the wiring connecting structure in connector 5 is shown. As shown in FIGS. 3 and 4, connector 5 has a case 5*a* having a box shape including a bottom and a cap 5*b*, which closes an open end of case 5*a*. Case 5*a* is fixed to ring case 4 by a pair of first hooks 10*a* formed on ring-shaped plate 10 which engage a pair of first receiving portions $\mathbf{5}a_1$ formed on case 5*a*. Cap 5*b* is fixed to case 5*a* by engaging a plurality of second receiving portions $\mathbf{5}a_2$ formed at case 5*a* with a plurality of hooks $\mathbf{5}b_1$ formed at cap 5*b*. A projection portion $\mathbf{5}a_3$, which is formed on case 5*a*, is inserted into an opening 4*a*. An O-ring 11, which is disposed in an annular groove formed on case 5*a*, surrounds opening 4*a* and abuts the closed end surface of ring case 4.

As shown in FIGS. 4–6, first end 2*a* and second end 2*b* of electrical wire 2 are introduced into opening 4*a* through a notched portion 1*a* formed on a first end surface of ring member 1 and are extended into connector 5 through a pair of penetrating holes $\mathbf{5}a_4$, which are formed through projection portion $\mathbf{5}a_3$. A contact 12 having a first electric connection is connected to an end of second lead 6*b*, which is inserted into connector 5. In addition, contact 12 having a second electric connection is connected to an end of first lead 6*a*, which is inserted into connector 5. First end 2*a*of electrical wire 2 is supported between a first receiving portion formed at case 5*a*of connector 5 and a second receiving portion formed at contact 12, which is connected to first lead 6*a*. Second end 2*b* of electrical wire 2 is supported between a third receiving portion formed at case 5*a* of connector 5 and a fourth receiving portion formed at contact 12, which is connected to lead 6*b*. Thus, first end 2*a* and second end 2*b* of electrical wire 2 are connected to first lead 6*a* and second lead 6*b*, respectively.

Coil bobbin 3 is fixed to ring case 4 by a resin 13 (e.g., an epoxy resin), which is poured into an open end of the annular groove of ring case 4. O-ring 11, which is disposed between case 5*a* and the closed end surface of ring case 4, prevents resin 13 from leaking to the outside of the closed end surface of ring case 4 through the gap between projection portion $\mathbf{5}a_3$ of case 5*a* and a surrounding wall of opening 4*a*, when resin 13 is poured into ring case 4.

In a known electromagnet assembly for use in an electromagnetic apparatus, it is necessary to engage the plurality of hooks $\mathbf{5}b_1$ to the plurality of second receiving portions $\mathbf{5}a_2$ when cap 5*b* of connector 5 is fixed to case 5*a*. Therefore, the manufacturing efficiency of fixing cap 5*b* to case 5*a* is low because this process is done by hand. Further, if the interior of case 5*a* does not fill with resin, water may enter into the interior of case 5*a* through the gap between cap 5*b* and case 5*a*, which is adjacent to an engagement portion of hook $\mathbf{5}b_1$ and second receiving portion $\mathbf{5}a_2$, and the insulation capabilities of connecting portions of first end 2*a* and second end 2*b* of electrical wire 2 and contact 12 may be reduced. Therefore, it may be necessary to refill the interior of case 5*a* with resin 13, and the manufacturing efficiency of fixing cap 5*b* to case 5*a* may be reduced.

SUMMARY OF THE INVENTION

An object of the present invention is to provide an electromagnet assembly for use in an electromagnetic apparatus which has a greater manufacturing efficiency in fixing a cap to a case of a connector, when compared with a known electromagnet assembly.

In an embodiment of the present invention, an electromagnet assembly for an electromagnetic apparatus comprises a ring member, a coil bobbin, a ring case, and a connector. The ring member comprises a tubular spool, e.g., cylindrical spool, with a pair of annular flanges projecting radially from the spool. The coil bobbin comprises an electrical wire. The electrical wire is wound around the spool between the flanges. The ring case comprises an annular groove, which has an open edge. The coil bobbin is disposed in the ring case's annular groove. An opening is formed through the ring case adjacent to its closed end surface. The connector comprises a case and a cap. The case forms an enclosure, such as a cylinder or a box, having an open end and a bottom. The cap closes the open end of the case. The connector is disposed on the ring case adjacent to its closed end surface and covers the opening. A first end and a second end of the electrical wire, and a first lead wire and a second lead wire from an external electric circuit are connected to the first and the second ends, respectively in the connector. A projection portion is formed around a fringe portion of a first end surface of the cap and abuts an open end surface of the case. The cap is secured fixedly to the case after the projection portion is melted.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
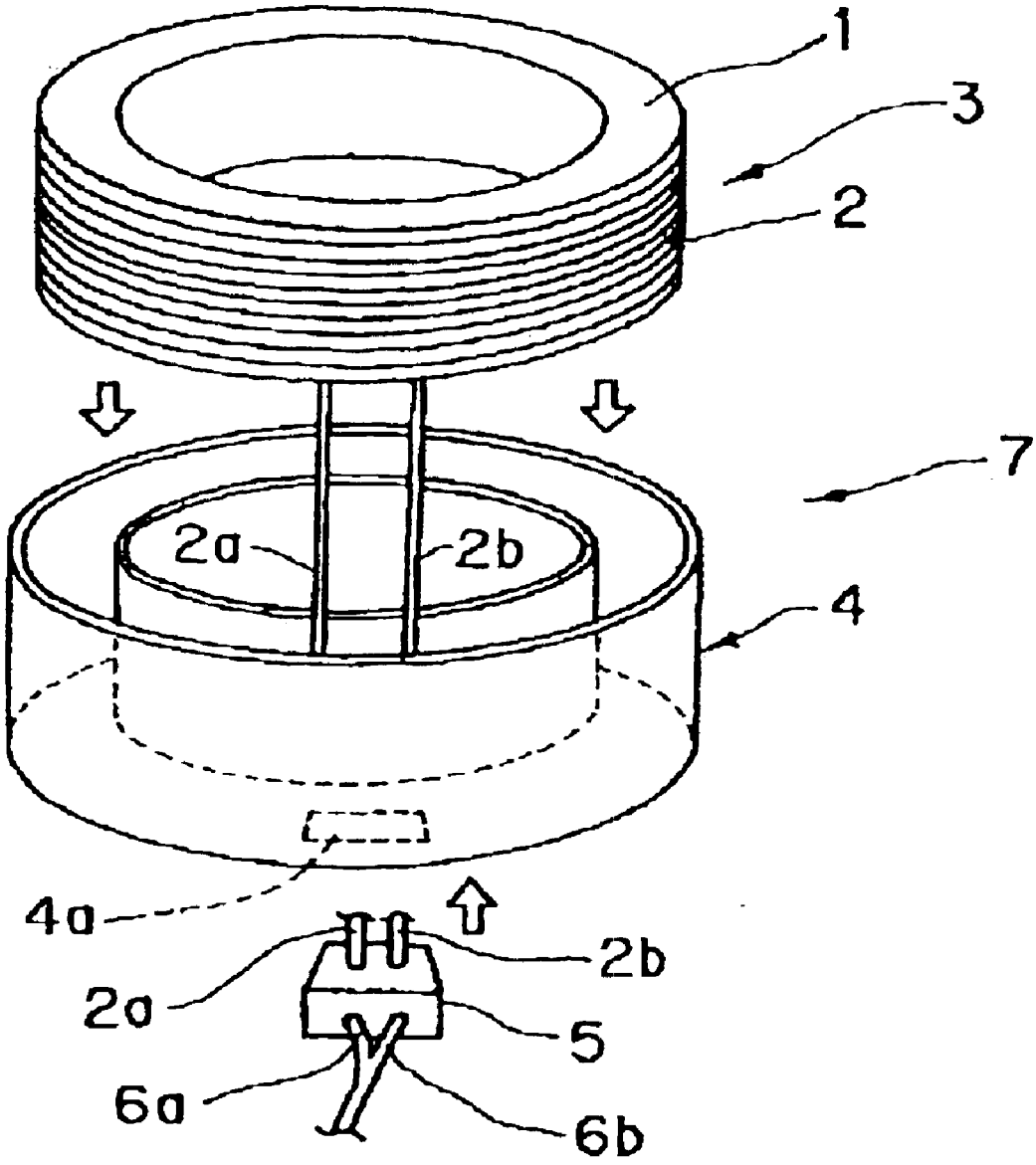
Prior Art Fig. 1
FIG. 1 is a perspective and exploded view of a known electromagnet assembly for use in an electromagnetic apparatus.
Figure 2:
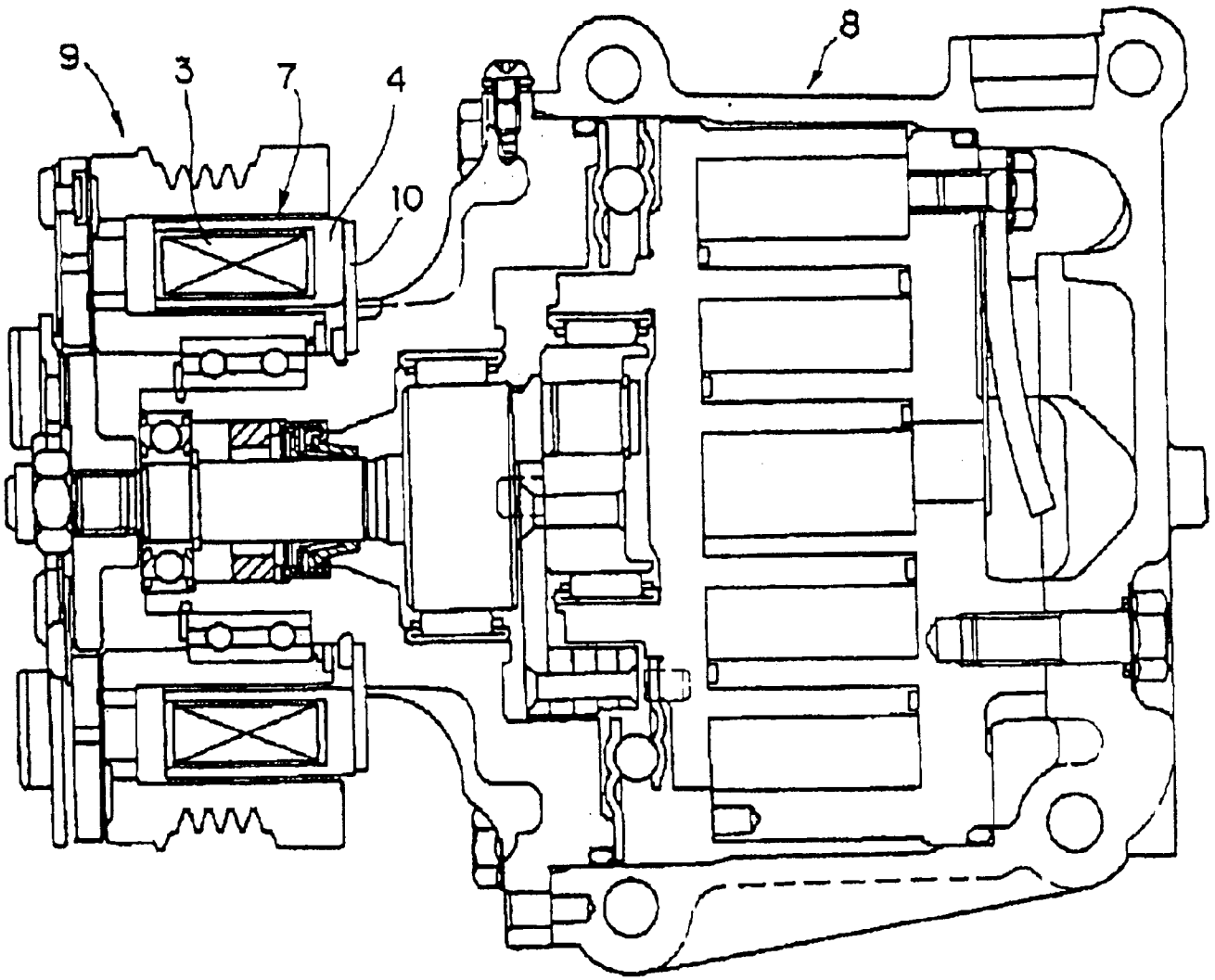
Prior Art Fig. 2
FIG. 2 is a longitudinal, cross-sectional view of a known compressor for use in an automotive air-conditioning system, which includes an electromagnetic clutch having the known electromagnet assembly.
Figure 3:
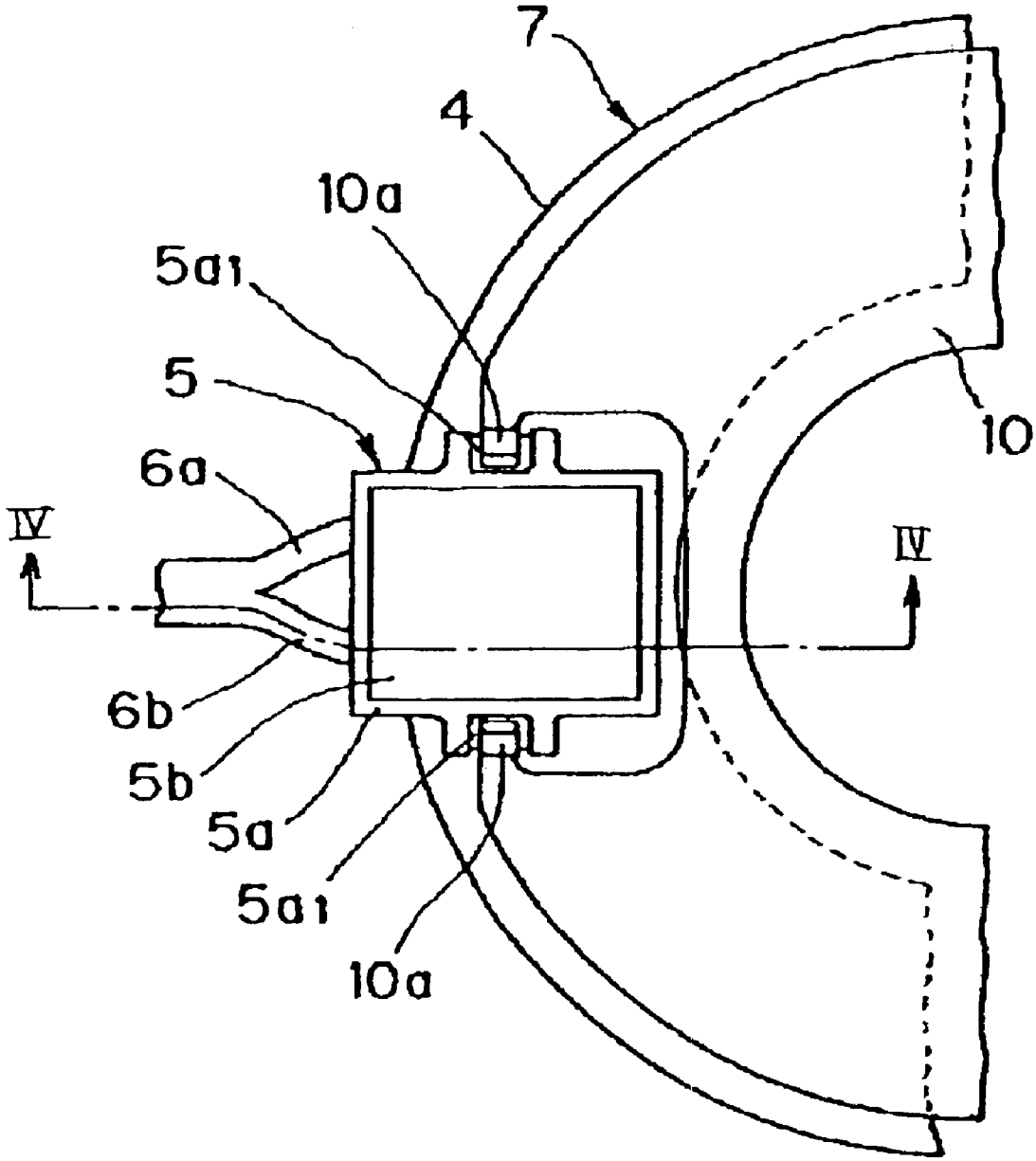
Prior Art Fig. 3
FIG. 3 is a plan view of a closed end surface side of a ring case of the known electromagnet assembly.
Figure 4:
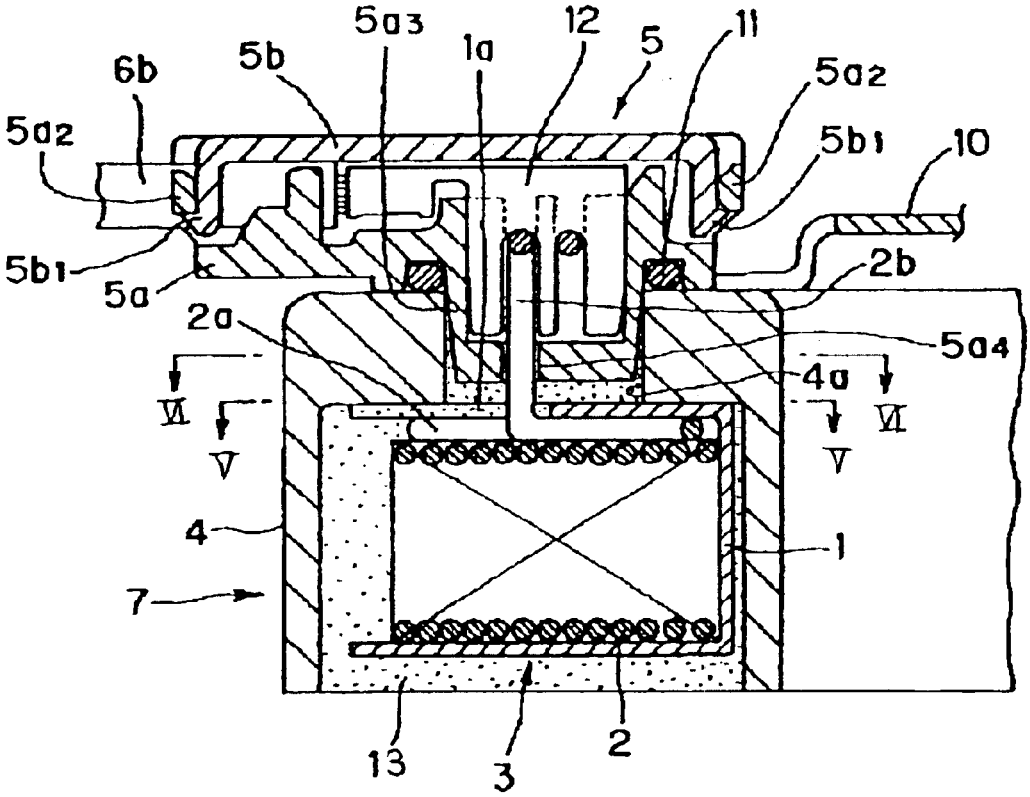
Prior Art Fig. 4
FIG. 4 is a cross-sectional view taken along the line IV—IV of FIG. 3.
Figure 5:
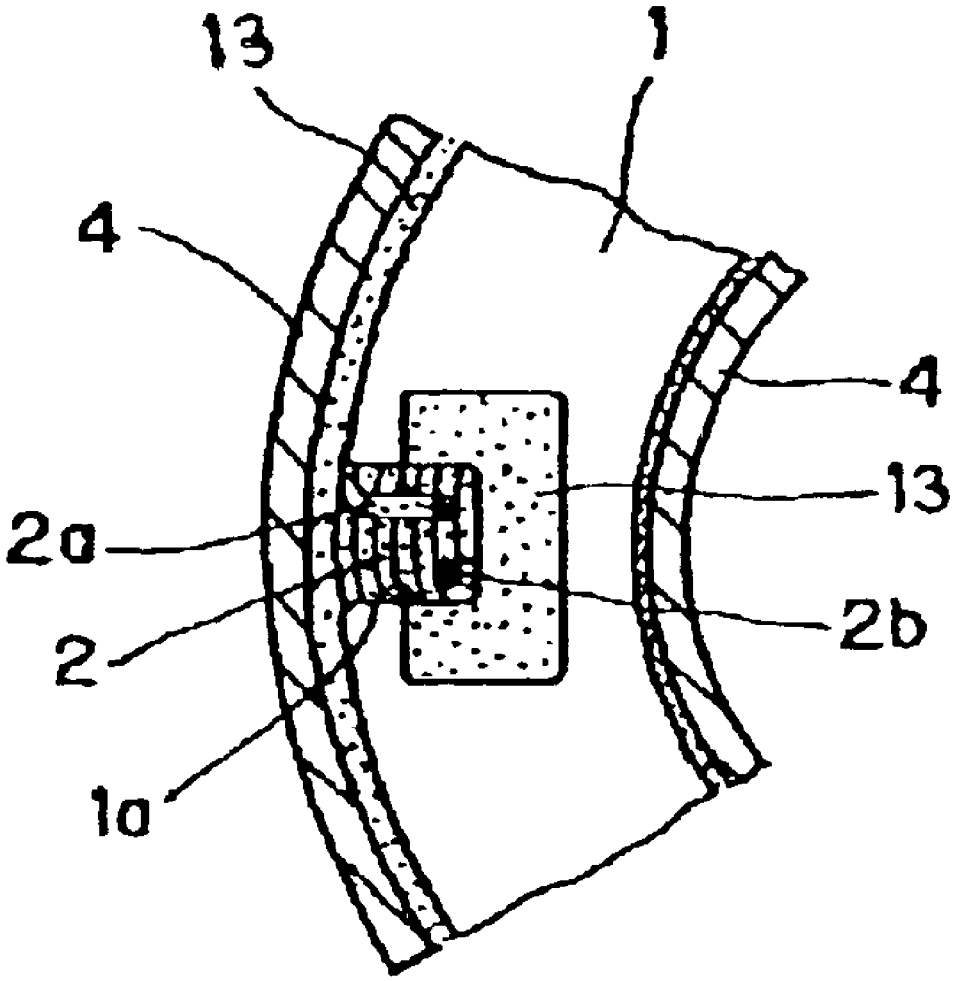
Prior Art Fig. 5
FIG. 5 is a cross-sectional view taken along the line V—V of FIG. 4.
Figure 6:
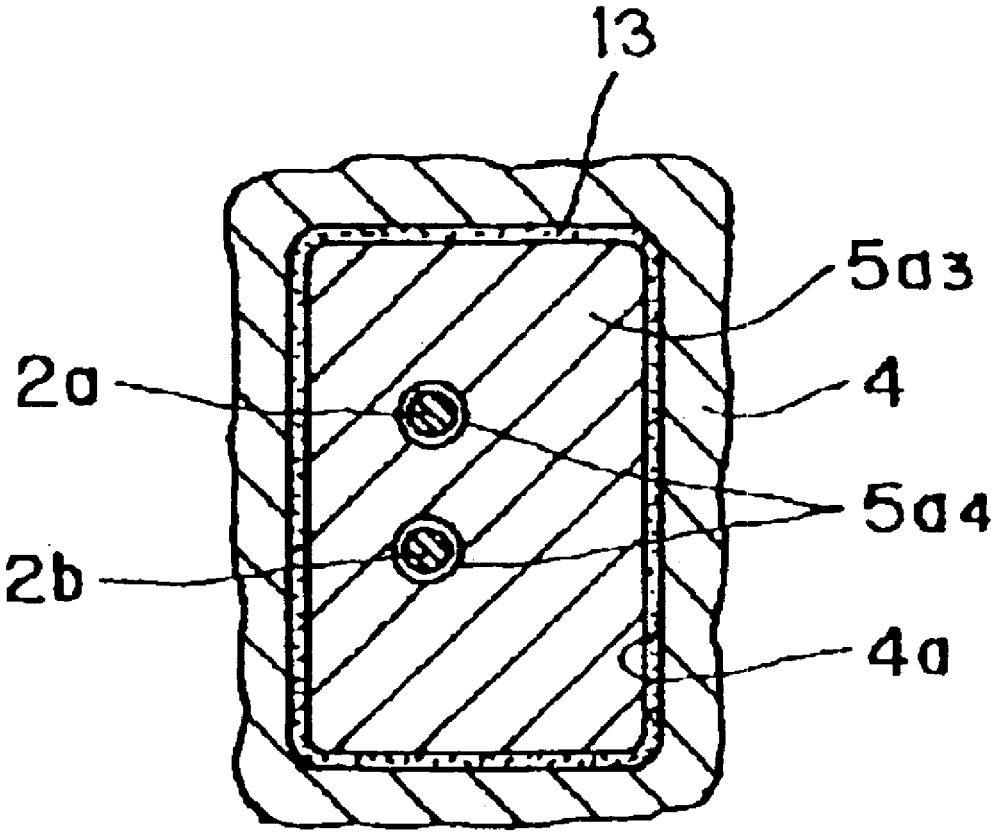
Prior Art Fig. 6
FIG. 6 is a cross-sectional view taken along the line of VI—VI of FIG. 4.
Figure 7:
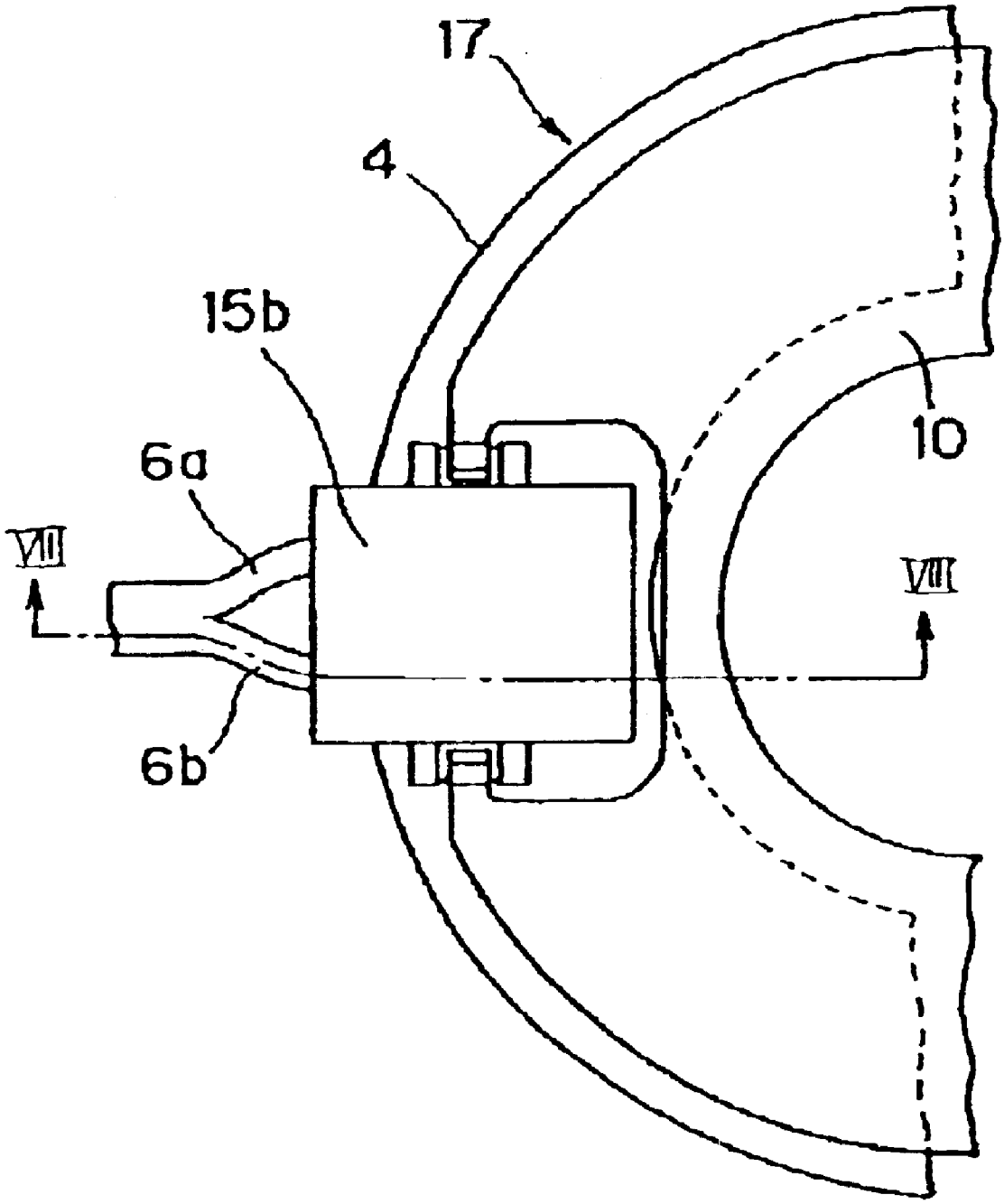
FIG. 7 is a plan view of a closed end surface side of a ring case of an electromagnet assembly for use in an electromagnetic apparatus, according to a first embodiment of the present invention.
Figure 8:
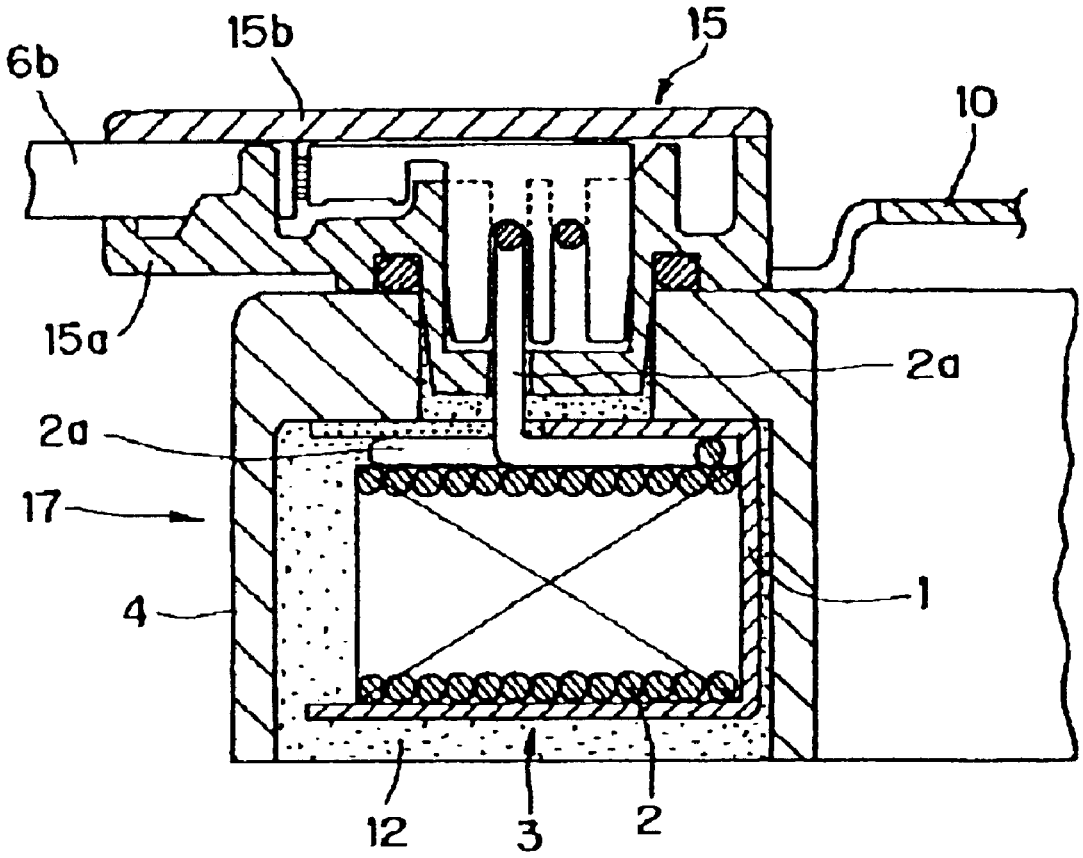
FIG. 8 is a cross-sectional view taken along the line of VIII—VIII of FIG. 7.
Figure 9:
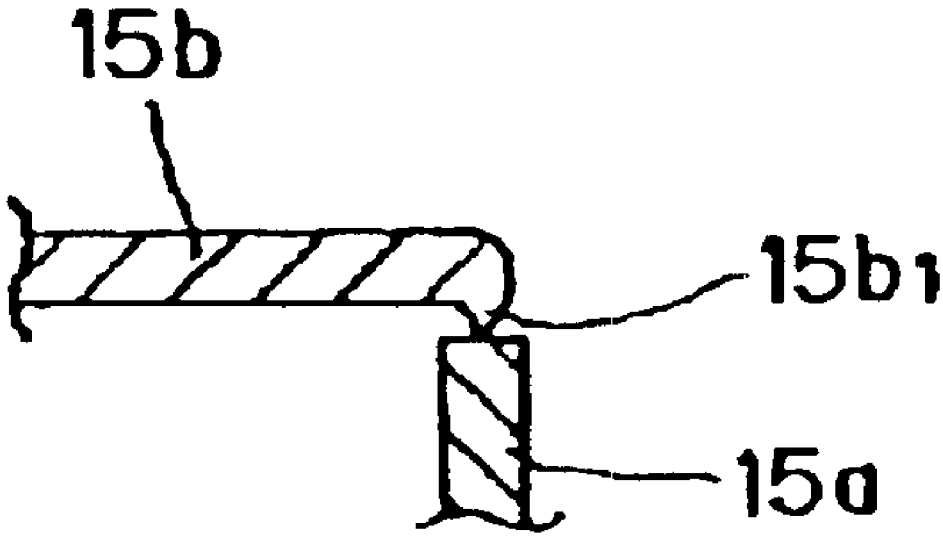
FIG. 9 is a cross-sectional view of a case and a cap of a connector of the electromagnet assembly before the cap is secured fixedly to the case, according to the first embodiment of the present invention.

Referring to FIGS. 7–9, a first embodiment of the present invention of an electromagnet assembly for use in an electromagnetic apparatus, e.g., an electromagnetic clutch, is shown. In the following explanation and FIGS. 7–9, the same reference numbers are used to represent the same parts of an electromagnet assembly 17 for use in an electromagnetic apparatus as shown FIGS. 1–6. Therefore, further explanation of similar parts is here omitted.

In electromagnet assembly 17 according to this embodiment, a cap 15*b* of a connector 15 is secured fixedly to an open end surface of a case 15*a* of connector 15 by a high frequency adhesion or an ultrasonic adhesion, or the like. As shown in FIG. 9, a projection portion $\mathbf{15}b_1$ is formed around a fringe portion of a first end surface of cap 15*b* and abuts the open end surface of case 15*a*. In FIG. 9, cap 15*b* is not secured fixedly on an open end surface of case 15*a*. A resin, e.g., an epoxy resin, is not poured into an interior of case 15. The structure of electromagnet assembly 17 of this embodiment is substantially the same as the known electromagnet assembly 7, except as described above.

In electromagnet assembly 17, cap 15*b* covers the open end surface of case 15*a*. Cap 15*b* is secured fixedly to the open end surface of case 15*a*, and the abutting portions of cap 15*b* and case 15*a* are melted and fixed together. A process for fixing cap 15*b* to case 15*a* may be easily automated. Consequently, the manufacturing efficiency of fixing cap 15*b* to case 15*a* may be increased. No gap is present between cap 15*b* and case 15*a* after cap 15*b* has been securedly fixedly to the open end surface of case 15*a*. Therefore, the entry of water into the interior of case 15*a* may be prevented. As a result, filling the interior of case 15*a* with the resin is no longer necessary. A projection portion $\mathbf{15}b_1$, which is formed around a fringe portion of a first end surface of cap 15*b* and covers the open end surface of case 15*a*, has a smaller cross-sectional area and a smaller cubic volume compared to cap 15*b*. Therefore, projection portion $\mathbf{15}b_1$ is readily and completely melted, and may adhere strongly to the open end surface of case 15*a*. As a result, cap 15*b* may be fixed securely to case 15*a*.

Figure 10:
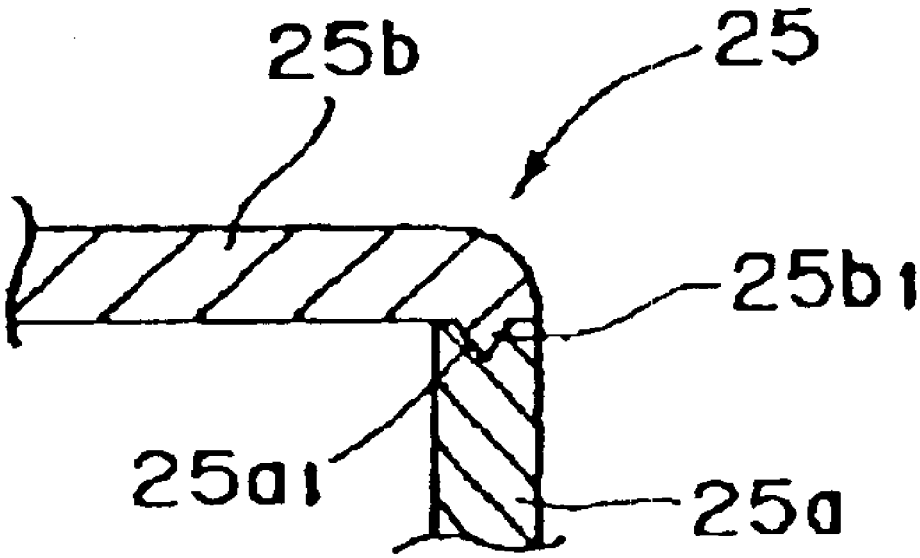
FIG. 10 is a cross-sectional view of a case and a cap of a connector of an electromagnet assembly before the cap is secured fixedly to the case, according to a second embodiment of the present invention.

Referring to FIG. 10, a second embodiment of the present invention of an electromagnet assembly for use in an electromagnetic apparatus is shown. In this embodiment of an electromagnet assembly, a projection portion $\mathbf{25}b_1$ is formed around a fringe portion of a first end surface of a cap 25*b* of a connector 25 and abuts the open end surface of a case 25*a* of connector 25, and a concave portion $\mathbf{25}a_1$, which engages with projection portion $\mathbf{25}b_1$, is formed on the open end surface of a case 25*a*. In FIG. 10, cap 25*b* is not secured fixedly on an open end surface of case 25*a*. The structure of this embodiment of the electromagnet assembly is the same as the first embodiment of electromagnet assembly 17, except as described above. An area of the abutting portions between cap 25*b* and case 25*a* is increased because projection portion $\mathbf{25}b_1$ of cap 25*b* engages concave portion $\mathbf{25}a_1$ of case 25*a*. As a result, a fixing area of cap 25*b* and case 25*a* is increased, and, consequently, cap 25*b* may be more strongly fixed to case 25*a*.

Figure 11:
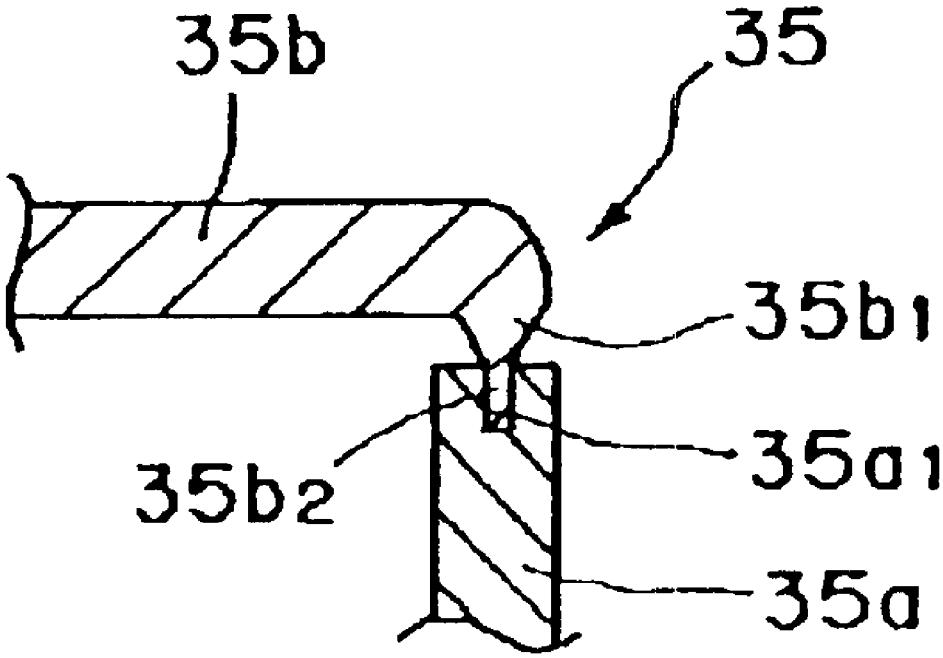
FIG. 11 is a cross-sectional view of a case and a cap of a connector of an electromagnet assembly before the cap is secured fixedly to the case, according to a third embodiment of the present invention.

Referring to FIG. 11, a third embodiment of the present invention of an electromagnet assembly for use in an electromagnetic apparatus is shown. In this embodiment of an electromagnet assembly, a first projection portion $\mathbf{35}b_1$ is formed around a fringe portion of a first end surface of a cap 35*b* of a connector 35 and covers the open end surface of a case 35*a* of connector 35, and a plurality of second projection portions $\mathbf{35}b_2$, which determine a position for engaging cap 35*b* with case 35*a*, project from a tip of first projection portion $\mathbf{35}b_1$ at proper positions. A concave portion $\mathbf{35}a_1$, which faces the plurality of second projection portions $\mathbf{35}b_2$ and engages with the plurality of second projection portions $\mathbf{35}b_2$, is formed on the open end surface of a case 35*a*. In FIG. 11, cap 35*b* is not secured fixedly on an open end surface of case 35*a*. The structure of this embodiment of the electromagnet assembly is substantially the same as the first embodiment of electromagnet assembly 17, except as described above. Consequently, when preparations for fixing are completed, cap 35*b* may be readily positioned against case 35*a* because the plurality of second projection portions 35*b*$_2$ of cap 35*b* engage concave portion 35*a*$_1$ of case 35*a*. As a result, the process for fixing cap 35*b* to case 35*a* may achieve increased productivity.

Figure 12:
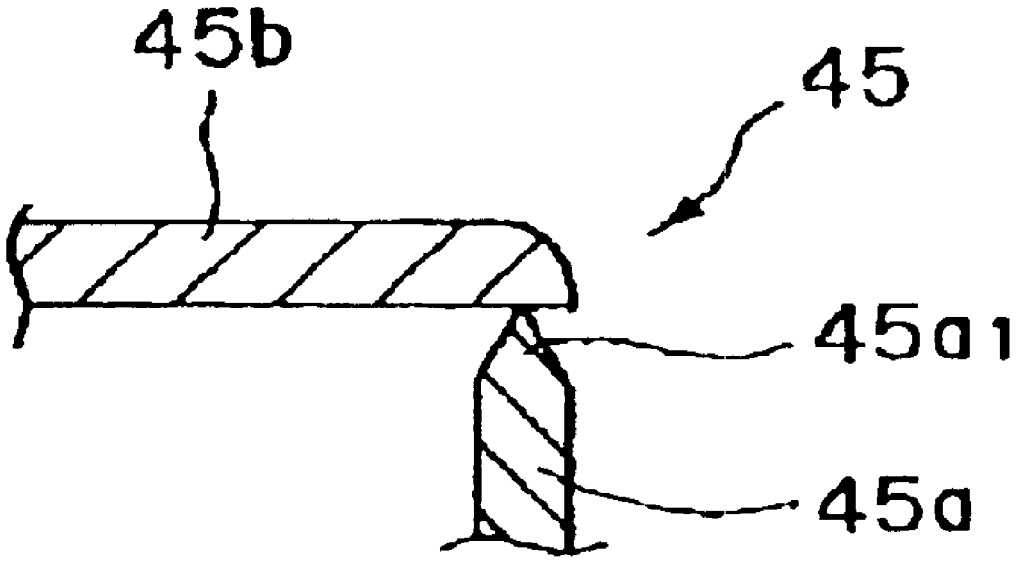
FIG. 12 is a cross-sectional view of a case and a cap of a connector of an electromagnet assembly before the cap is secured fixedly to the case, according to a fourth embodiment of the present invention.

Referring to FIG. 12, a fourth embodiment of the present invention of an electromagnet assembly for use in an electromagnetic apparatus is shown. In this embodiment of an electromagnet assembly, a projection portion 45*a*$_1$ is formed on the open end surface of a case 45*a* along its open end surface of case 45*a* of a connector 45. In FIG. 12, a cap 45*b* is not secured fixedly on an open end surface of case 45*a*. The structure of this embodiment of the electromagnet assembly is the same as the first embodiment of electromagnet assembly 17, except that a projection portion is formed on an open end surface of a case instead of forming a projection portion on a cap. Projection portion 45*a*$_1$, which is formed on the open end surface of case 45*a*, has a smaller cross-sectional area and a smaller cubic volume, as compared to case 45*a*. Therefore, projection portion 45*a*$_1$ is readily and completely melted and may adhere strongly to cap 45*b*. As a result, cap 45*b* may be more strongly fixed to case 45*a*.

Figure 13:
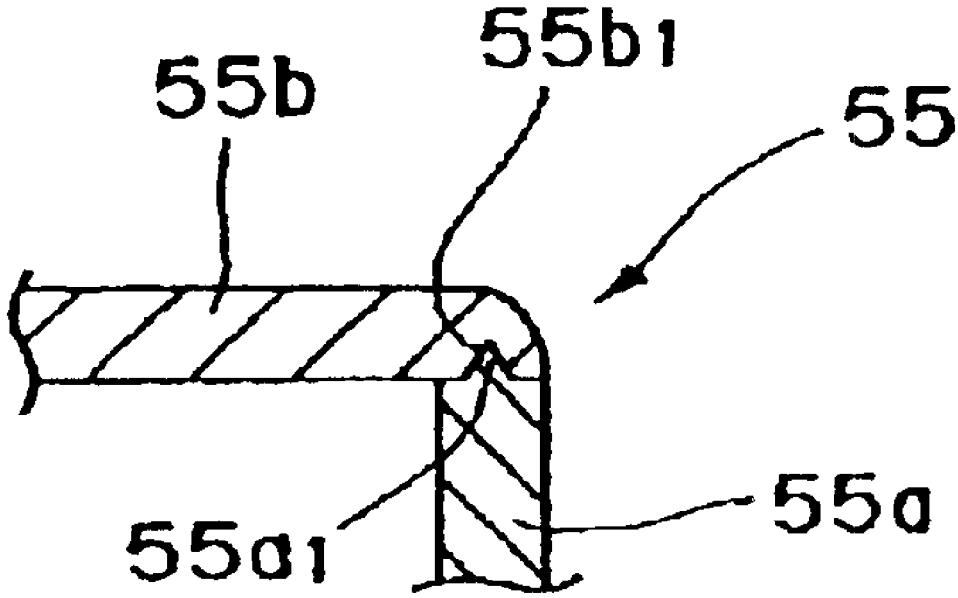
FIG. 13 is a cross-sectional view of a case and a cap of a connector of an electromagnet assembly before the cap is secured fixedly to the case, according to a fifth embodiment of the present invention.

Referring to FIG. 13, a fifth embodiment of the present invention of an electromagnet assembly for use in an electromagnetic apparatus is shown. In this embodiment of an electromagnet assembly, a projection portion 55*a*$_1$ is formed on an open end surface of a case 55*a* along the open end surfac of a connector 55, and a concave portion 55*b*$_1$, which engages with projection portion 55*a*$_1$, is formed around a fringe portion of a first end surface of a cap 55*b*. In FIG. 13, cap 55*b* is not secured fixedly on the open end surface of case 55*a*. The structure of this embodiment of the electromagnet assembly is substantially the same as the first embodiment of electromagnet assembly 17, except as described above. An area of the abutting portions of cap 55*b* and of case 55*a* is increased because projection portion 55*a*$_1$ of case 55*a* engages concave portion 55*b*$_1$ of cap 55*b*. As a result, a fixing area of cap 55*b* and case 55*a* is increased, and cap 55*b* may be more strongly fixed to case 55*a*.

Figure 14:
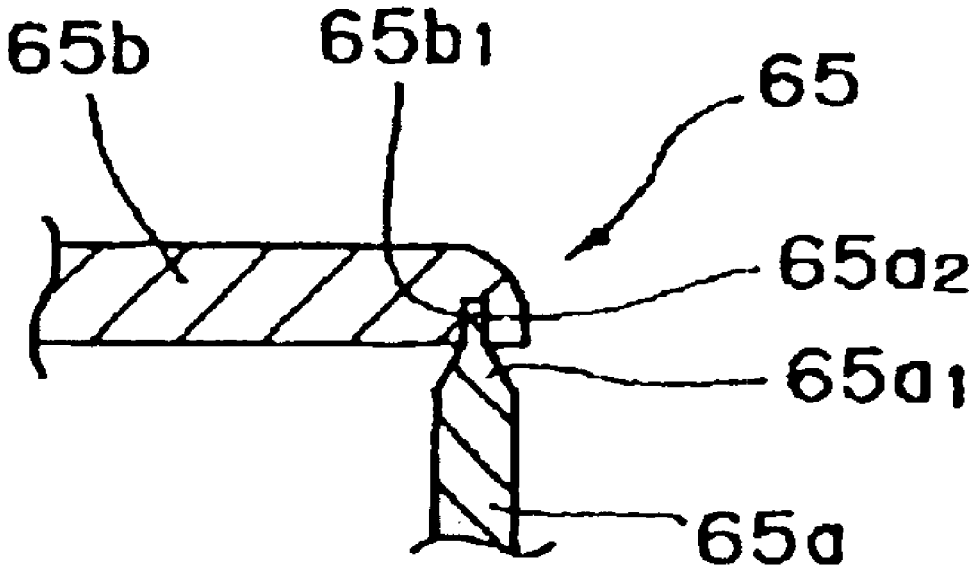
FIG. 14 is a cross-sectional view of a case and a cap of a connector of an electromagnet assembly before the cap is secured fixedly to the case, according to a sixth embodiment of the present invention.

Referring to FIG. 14, a sixth embodiment of the present invention of an electromagnet assembly for use in an electromagnetic apparatus is shown. In this embodiment of an electromagnet assembly, a first projection portion 65*a*$_1$ is formed on an open end surface of a case 65*a* along the open end surface of a connector 65 and abuts a fringe portion of a first end surface of a cap 65*b*, and a plurality of second projection portions 65*a*$_2$, which determine a position for engaging cap 65*b* with case 65*a*, project from a tip of first projection portion 65*a*$_1$ at appropriate positions. A concave portion 65*b*$_1$, which faces the plurality of second projection portions 65*a*$_2$ and engages with the plurality of second projection portions 65*a*$_2$, is formed around the fringe portion of cap 65*b*. In FIG. 14, cap 65*b* is not secured fixedly on the open end surface of case 65*a*. The structure of this embodiment of the electromagnet assembly is substantially the same as electromagnet assembly 17, except as described above. Consequently, when preparations for fixing are completed, cap 65*b* may be readily positioned against case 65*a* because the plurality of second projection portions 65*a*$_2$ of case 65*a* engage concave portion 65*b*$_1$ of cap 65*b*. As a result, the process for fixing cap 65*b* to case 65*a* may achieve increased productivity.

Figure 15A:
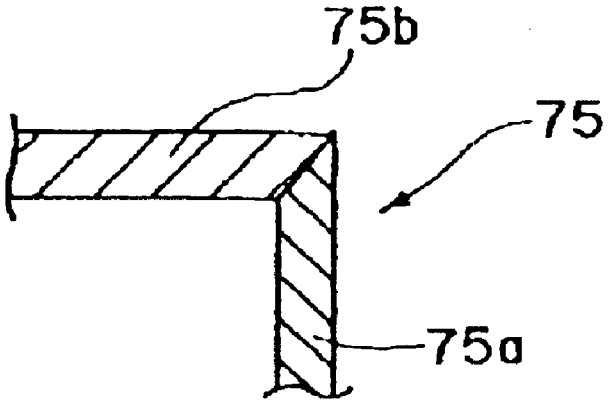
FIG. 15 is a cross-sectional view of a case and a cap of a connector of an electromagnet assembly before the cap is secured fixedly to the case, according to a seventh embodiment of the present invention.
Figure 15B:
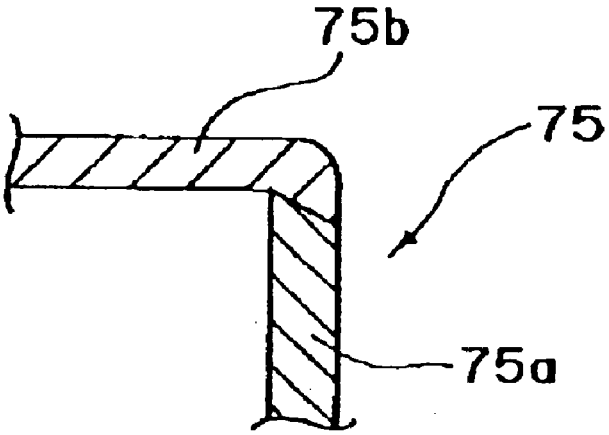

Referring to FIGS. 15*a* and 15*b*, a seventh embodiment of the present invention of an electromagnet assembly for use in an electromagnetic apparatus is shown. In this embodiment of an electromagnet assembly, an open end surface of a case 75*a* of a connector 75 is angled, and a fringe portion of a first end surface of a cap 75*b*, which faces the open end surface of case 75*a*, is angled to correspond to the angled open end surface of case 75*a*. For example, in FIG. 15*a*, the angle portion of case 75*a* and cap 75*b* bisect the corner formed by their abutment. Alternatively, in FIG. 15*b*, the corner formed by the abutment of case 75*a* and cap 75*b* is primarily comprised of cap 75*b*. In FIGS. 15*a* and 15*b*, cap 75*b* is not secured fixedly on the open end surface of case 75*a*. The structure of this embodiment of the electromagnet assembly is substantially the same as the first embodiment of electromagnet assembly 17, except that the open end surface of a case 75*a* and the fringe portion of a first end surface of a cap 75*b* are angled. An area of the abutting portion between cap 75*b* and case 75*a* is increased because the angled fringe portion of the first end surface of a cap 75*b* abuts the angled open end surface of case 75*a*. As a result, fixing area of cap 75*b* and case 75*a* is increased, and cap 75*b* may be more strongly fixed to case 75*a*.

Figure 16A:
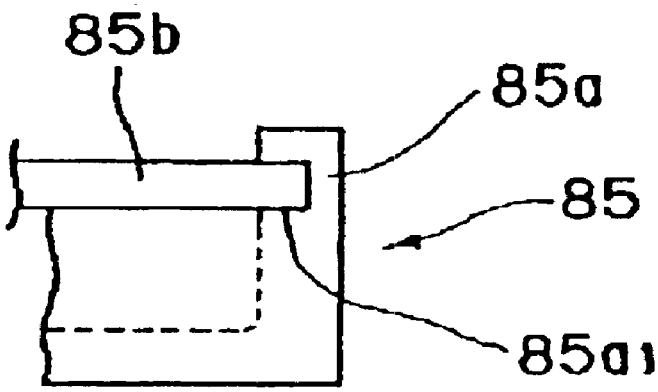
FIG. 16 is a cross-sectional view of a case and a cap of a connector of an electromagnet assembly before the cap is secured fixedly to the case, according to a eighth embodiment of the present invention.
Figure 16B:
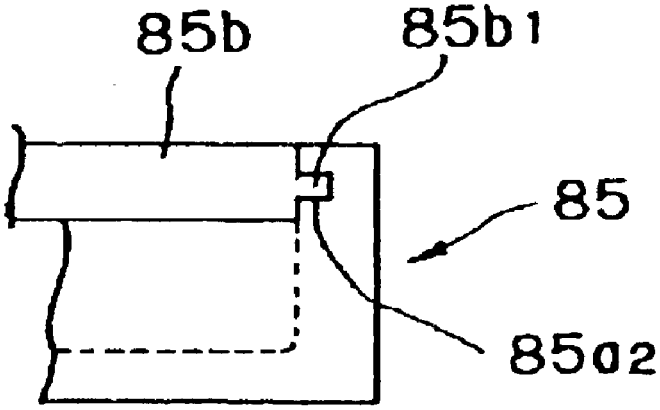

Referring to FIGS. 16*a* and 16*b*, an eighth embodiment of the present invention of an electromagnet assembly for use in an electromagnetic apparatus is shown. In this embodiment of an electromagnet assembly, as shown in FIG. 16*a*, a groove 85*a*$_1$ is formed on an interior side wall of a case 85*a* of a connector 85 and is adjacent to an open end surface of case 85*a*. A fringe portion of a cap 85*b* of connector 85 is inserted into groove 85*a*$_1$. As shown in FIG. 16*b*, a groove 85*a*$_2$ is formed on an interior side wall of case 85*a* of connector 85 and is adjacent to an open end surface of case 85*a*. A projection portion 85*b*$_1$, which is formed around a side wall of cap 85*b*, is inserted into groove 85*a*$_2$ of case 85*a*. In FIGS. 16*a* and 16*b*, cap 85*b* is not secured fixedly to the open end surface of case 85*a*. The structure of this embodiment of the electromagnet assembly is substantially the same as the first embodiment of electromagnet assembly 17, except that a groove is formed on a case or a projection portion is formed on a cap and a groove is formed on a case. In this embodiment, fringe portion of a cap 85*b* is inserted into groove 85*a*$_1$ formed on the interior side wall of case 85*a* and adjacent to the open end surface of case 85*a*. Alternatively, projection portion 85*b*$_1$ formed around the side wall of cap 85*b* is inserted into groove 85*a*$_2$ formed on the interior side wall of case 85*a* and is adjacent to the open end surface of case 85*a*. Therefore, an area of the abutting portion between cap 85*b* and case 85*a* is increased, and a fixing area between cap 85*b* and case 85*a* is increased. As a result, cap 85*b* may be more strongly fixed to case 85*a*.

Figure 17A:
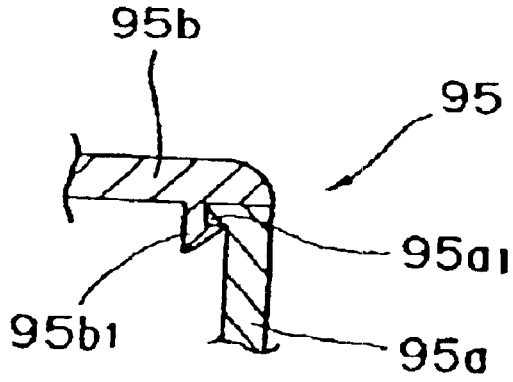
FIGS. 17*a* and 17*b* are cross-sectional views of a case and a cap of a connector of an electromagnet assembly before the cap is secured fixedly to the case, according to a ninth embodiment of the present invention.
Figure 17B:
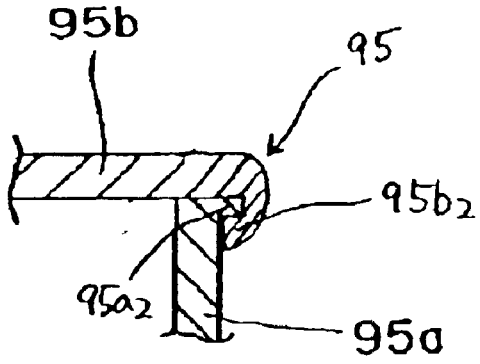

Referring to FIGS. 17*a* and 17*b*, a ninth embodiment of the present invention of an electromagnet assembly for use in an electromagnetic apparatus is shown. In this embodiment of an eleotromagnet assembly, as shown in FIG. 17*a*, a projection portion 95*a*$_1$ is formed around an interior wall at an open end surface of a case 95*a* of a connector 95. A hook portion 95*b*$_1$, which is formed on a first end surface of cap 95*b*, extends to engage projection portion 95*a*$_1$ of case 95*a*. As shown in FIG. 17*b*, a projection portion 95*a*$_2$ is formed around the exterior wall at the open end surface of a case 95*a*, and a hook portion 95*b*$_2$ is formed on the first end surface of cap 95*b*. Hook portion 95*b*$_2$ extends against projection portion 95*a*$_2$ of case 95*a* and engages projection portion 95*a*$_2$. In FIGS. 17*a* and 17*b*, cap 95*b* is not secured fixedly on the open end surface of case 95*a*. The structure of this embodiment of the electromagnet assembly is substantially the same as the first embodiment of electromagnet assembly 17, except that a projection portion is formed on a case and a hook portion is formed on a cap. In this embodiment, hook portion 95$b_1$ or hook portion 95$b_2$ of cap 95*b* engages with projection portion 95$a_1$ or projection portion 95$a_2$ of case 95*a*. Therefore, an area of the abutting portion between cap 95*b* and case 95*a* is increased, and a fixing area of cap 95*b* and case 95*a* is increased. As a result, cap 95*b* may be more strongly fixed to case 95*a*.

As described above, in the embodiments of the present invention of an electromagnet assembly for use in an electromagnetic apparatus, a cap is secured fixedly to an open end surface of a case by abutting the cap to the open end surface of the case of a connector. The process for fixing the cap to the case may be readily automated, and the manufacturing efficiency of fixing the cap to the case may be increased. The entry of water into an interior of the case may be prevented because the gap between the cap and the case is no longer formed after the cap is secured fixedly to the case. As a result, it is no longer necessary to fill the interior of the case with a resin, e.g., an epoxy resin. A projection portion, which is formed around a fringe portion of the first end surface of the cap and abuts the open end surface of the case, has a smaller cross-sectional area, and a smaller cubic volume, when compared to the cap. Therefore, the projection portion is readily and completely melted, and may adhere strongly to the open end surface of the case. As a result, the cap may be more strongly fixed to the case.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. An electromagnet assembly for an electromagnetic apparatus comprising:

a ring member comprising a tubular spool with a pair of annular flanges projecting radially from said spool;

a coil bobbin comprising said ring member and an electrical wire, said electrical wire wound around said spool between said flanges;

a ring case comprising an annular groove, which has an open edge, said coil bobbin disposed in said annular groove;

an opening formed through said ring case adjacent to said closed end surface of said ring case;

a connector comprising a case and a cap, said case having a closed shape and a bottom, said cap closing an open end of said case, said connector disposed on said ring case adjacent to said closed end surface and covering said opening; and a first end and a second end of said electrical wire, and a first lead wire and a second lead wire of an external electric circuit connected to said first and said second ends, respectively in said connector, wherein a projection portion is formed along an open end surface of said case and abuts a first end surface of said cap, wherein said cap is secured fixedly to said case after said projection portion is melted.

2. The electromagnet assembly of claim 1, wherein a concave portion is formed on said first end surface of said cap and engages said projection portion of said case.

3. The electromagnet assembly of claim 1, wherein a plurality of projection portions are formed on said open end surface of said case for engaging said cap, and a plurality of concave portions are formed on said first end surface of said cap for engaging said case, wherein said projection portions engages said concave portions.

* * * * *